United States Patent [19]

Senn et al.

[11] 4,121,952

[45] Oct. 24, 1978

[54] HARD MAGNETIC MATERIALS

[75] Inventors: Harufumi Senn, Yamato-Kouriyama; Yoshio Tawara, Shijyonawate, both of Japan

[73] Assignee: Matsushita Electric Industrial Co., Ltd., Japan

[21] Appl. No.: 840,481

[22] Filed: Oct. 7, 1977

Related U.S. Application Data

[63] Continuation of Ser. No. 651,596, Jan. 22, 1976, abandoned.

[30] Foreign Application Priority Data

Oct. 9, 1975 [JP] Japan ..... 50-122693

[51] Int. Cl.[2] ..... H01F 1/04

[52] U.S. Cl. ..... 148/31.57; 148/101

[58] Field of Search ..... 148/31.57, 101

[56] References Cited

U.S. PATENT DOCUMENTS 3,947,295 3/1976 Tawara et al. ..... 148/31.57

3,982,971 9/1976 Yamanaka et al. ..... 148/31.57

OTHER PUBLICATIONS

Perry et al., "Magnetic Properties of $R(Co_{1-y}Cu_y)_z$ Compds", Cobalt & Cobalt Abstracts, Jun. 1975, p. A27.

Senno et al., "Magnetic Properties of Sm-Co-Fe-Cu Alloys . . .", Jap. J. Appl. Phys., 14, (1975), 1619.

Tawara et al., "Bulk Hardened Magnet . . . Rare Earth-Cobalt", Jap. J. Appl. Phys., 12, (1975), 761.

*Primary Examiner*—L. Dewayne Rutledge
*Assistant Examiner*—Upendra Roy
*Attorney, Agent, or Firm*—Wenderoth, Lind & Ponack

[57] ABSTRACT

Fine-grained sintered magnetic material having the composition expressed by SmMz where M is essentially cobalt or a combination of cobalt, iron and copper, exhibits a large coercive force critically when the z-value is in the vicinity of 8. As small amount of zinc can be added to the raw material to aid in the sintering of the material.

1 Claim, 3 Drawing Figures

HARD MAGNETIC MATERIALS

This is a continuation, of application Ser. No. 651,596, filed Jan. 22, 1976, now abandoned.

An object of the present invention is to provide a novel and improved hard magnet material having improved superior magnetic characteristics, especially exceedingly high coercive force, and this is realized with a composition of $RM_z$, where R consists essentially Sm or a combination of Sm and Pr, M consists essentially Co or a combination of Co, Fe and Cu, and $z$ is about 8.0.

BRIEF DESCRIPTION OF THE DRAWINGS

This and other objects and features of the invention will be apparent from consideration of the following detailed description of the invention with accompanying the drawings in which.

DETAILED DESCRIPTION OF THE INVENTION

The hard magnetic material of the invention is most suitably described in terms of a general composition formula $RM_z$, where R represents rare earth elements, most preferably Sm, and M means essentially Co or a combination of Co, Fe and Cu. The inventors have found that the said composition when subjected to sintering exhibits an unexpectedly large coercive force when the $z$ value is close to 8.0. The dependence of coercive force on the $z$ value is very critical, and this will be understood from the following examples.

EXAMPLE 1

Alloys were prepared by melting ingredient metals in proper ratio so as to provide nominal composition of about $Sm(Co_{0.83}Fe_{0.05}Cu_{0.10}Zn_{0.02})_{8.0}$. Chemical analysis of several resultant specimens were as shown below.

| Specimen No. | | Content(wt.%) | | | | | |
|---|---|---|---|---|---|---|---|
| | | Sm | Co | Fe | Cu | Zn | Total |
| Z3 | as cast | 24.4 | 62.1 | 3.9 | 8.1 | 1.1 | 99.6 |
| Z6 | as cast | 24.0 | 62.5 | 3.9 | 8.2 | 1.1 | 99.7 |
| | sintered | 24.2 | 63.1 | 3.8 | 8.2 | <0.1 | 99.4 |
| Z12 | as cast | 23.5 | 62.6 | 4.0 | 8.0 | 1.1 | 99.2 |

For example, the sintered specimen No. Z6 can be expressed by the formula Z6 ≡ $Sm(Co_{0.843}Fe_{0.053}Cu_{0.101}Zn_{0.001})_{7.92}$ if other impurities not analyzed are not considered. However, chemical analysis of the absolute value of Sm content may be up to 0.5% in error. It should be noted that Zn hardly exists in a sintered body suggesting the fact that Zn evaporates off during sintering. Relative amounts of Sm to the rest of the composition of these alloys were determined from the intensity of characteristic X-ray of Sm by means of X-ray fluorescent analysis. The results were as shown below.

| Specimen No. | Relative amounts of Sm (Arbitrary Unit) |
|---|---|
| Z3 | 1.1746 |
| Z4 | 1.1751 |
| Z5 | 1.1643 |
| Z6 | 1.1527 |
| Z8 | 1.1561 |
| Z9 | 1.1379 |
| Z10 | 1.1472 |
| Z12 | 1.1179 |
| Z13 | 1.1443 |
| Z14 | 1.1230 |

The relative amount of Sm is most accurately determined in this way, although absolute value of the amount of Sm can not be determined.

Figure 1:
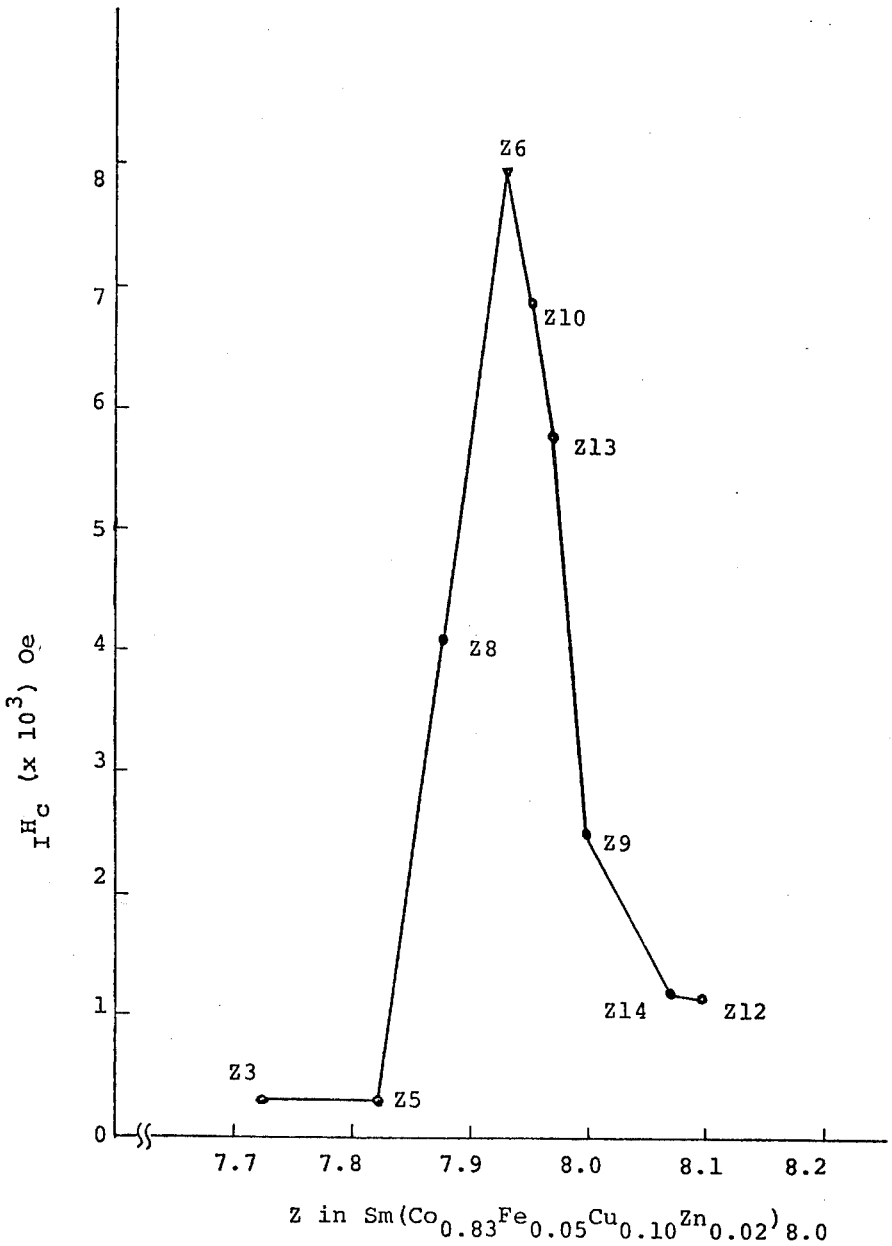
FIG. 1 is a graph showing intrinsic coercive force (for sintered specimens having compositions of about $Sm(Co_{0.85}Fe_{0.05}Cu_{0.10})_z$) as a function of $z$ value.

The alloys were crushed into coarse grains and then pulverized into fine powders whose average size was about 3 micron by jet milling. The powders were pressed in a magnetic field at 15KOe and were further compacted into green bodies by means of an isostatic pressing of about 3 tons/cm$^2$. The thus compacted bodies were sintered in vacuum of $5 \times 10^{-5}$ mmHg for 25 or 30 minutes at various temperatures between 1125°–1260° C. The best values of coercive force of the resultant sintered bodies were obtained at the sintering temperature of about 1240° C. FIG. 1 shows the best values of coercive force plotted against the $z$ value.

Chemical analysis showed that almost all of the Zn evaporated off during the sintering. The addition of small amount of Zn has an effect of promoting the sintering thus resulting in a better shrinkage of the specimens, although the final sintered products do not contain significant amounts of Zn.

Figure 2:
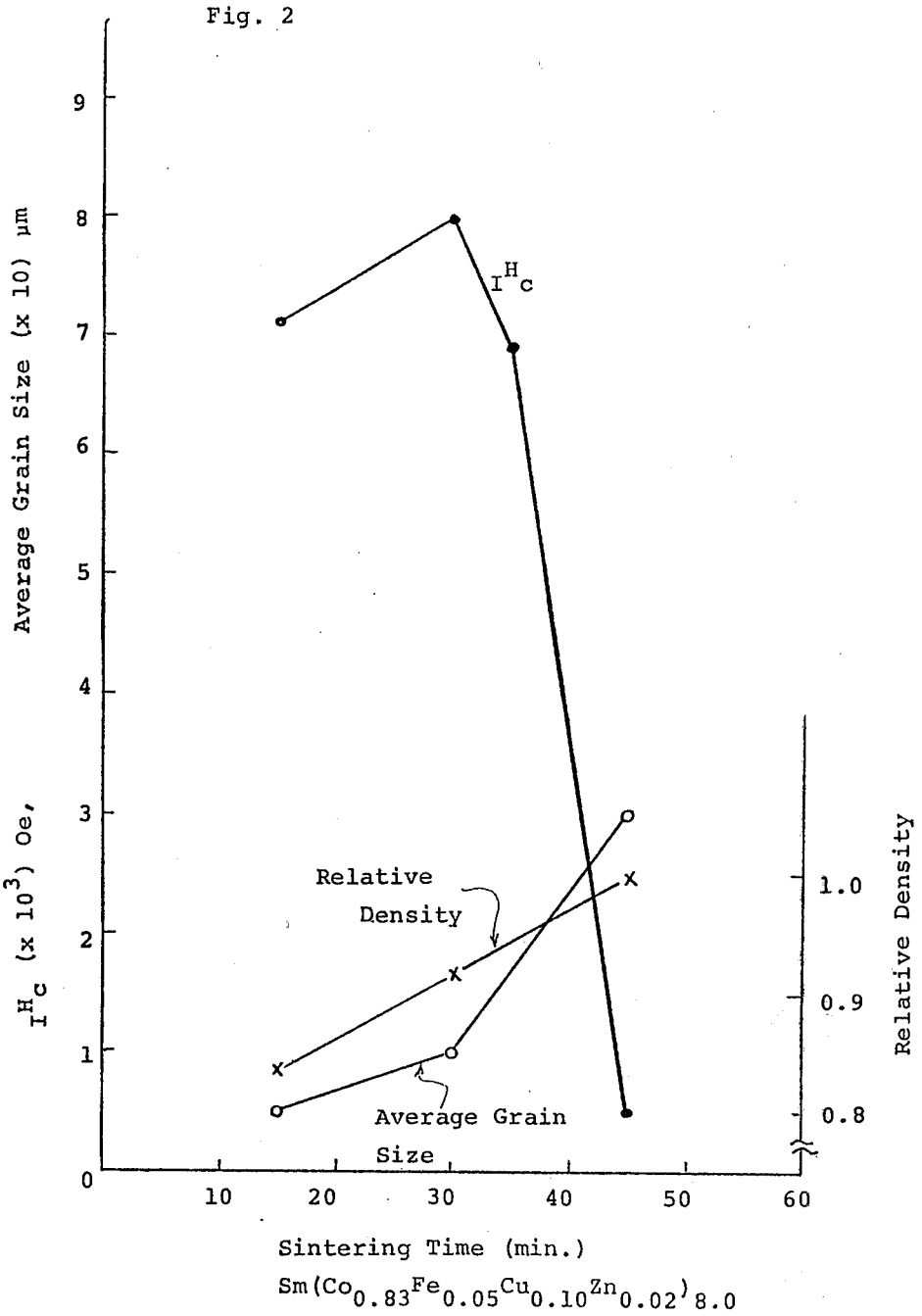
FIG. 2 shows intrinsic coercive force, average grain size and density as function of a sintering time at sintering temperature of 1230° C for cast bodies of sintered specimens of this invention having the nominal composition of about $Sm(Co_{0.83}Fe_{0.05}Cu_{0.1})_{8.0}$.

FIG. 2 shows intrinsic coercive force, average grain size and density of the resultant sintered specimens having the nominal composition of $Sm(Co_{0.83}Fe_{0.05}Cu_{0.1}Zn_{0.02})_{8.0}$ as function of a sintering time at a sintering temperature of 1230° C.

EXAMPLE 2

The powders corresponding to Z12 and Z4 of Example 1 were mixed in a proper ratio so as to provide the Z6 composition. The mixed powders were subjected to the same process as that of Example 1, and the resultant sintered bodies exhibited a coercive force between 5,000 and 8,000 Oe which was essentially the same as the optimum value of the coercive force in Example 1.

EXAMPLE 3

Specimens of Z17, Z18, Z19 and Z20 with nominal compositions of about $sm(Co_{0.83}Fe_{0.05}Cu_{0.10})_{8.0}$ were prepared by the same method as that of Example 1. Relative amounts of Sm in these specimens are tabulated below in the same unit as that of Example 1. The results are summarized as follows.

| Specimen No. | Relative amount of Sm (Arbitrary Unit) | Sintering temperature (° C) | Sintering time (min.) | $I^H c$ (Oe) |
|---|---|---|---|---|
| Z17 | 1.1216 | 1190 | 30 | 1900 |
| Z18 | 1.1567 | 1140 | 30 | 14000 |
| Z19 | 1.1724 | 1140 | 30 | 13800 |
| Z20 | 1.1372 | 1140 | 30 | 2400 |
| Z21 | 1.1822 | 1140 | 30 | 600 |
| Z22 | 1.1563 | 1140 | 25 | 14300 |
| Z23 | 1.1349 | 1140 | 25 | 10600 |
| Z24 | 1.1292 | 1140 | 25 | 14100 |
| Z25 | 1.1185 | 1135 | 25 | 12000 |

-continued

| Specimen No. | Relative amount of Sm (Arbitrary Unit) | Sintering temperature (° C) | Sintering time (min.) | $I^{H}c$ (Oe) |
|---|---|---|---|---|
| Z26 | 1.1363 | 1140 | 25 | 2200 |
| Z27 | 1.1344 | 1119 | 25 | >15000 |
| Z28 | 1.1314 | 1125 | 25 | 13600 |

Figure 3:
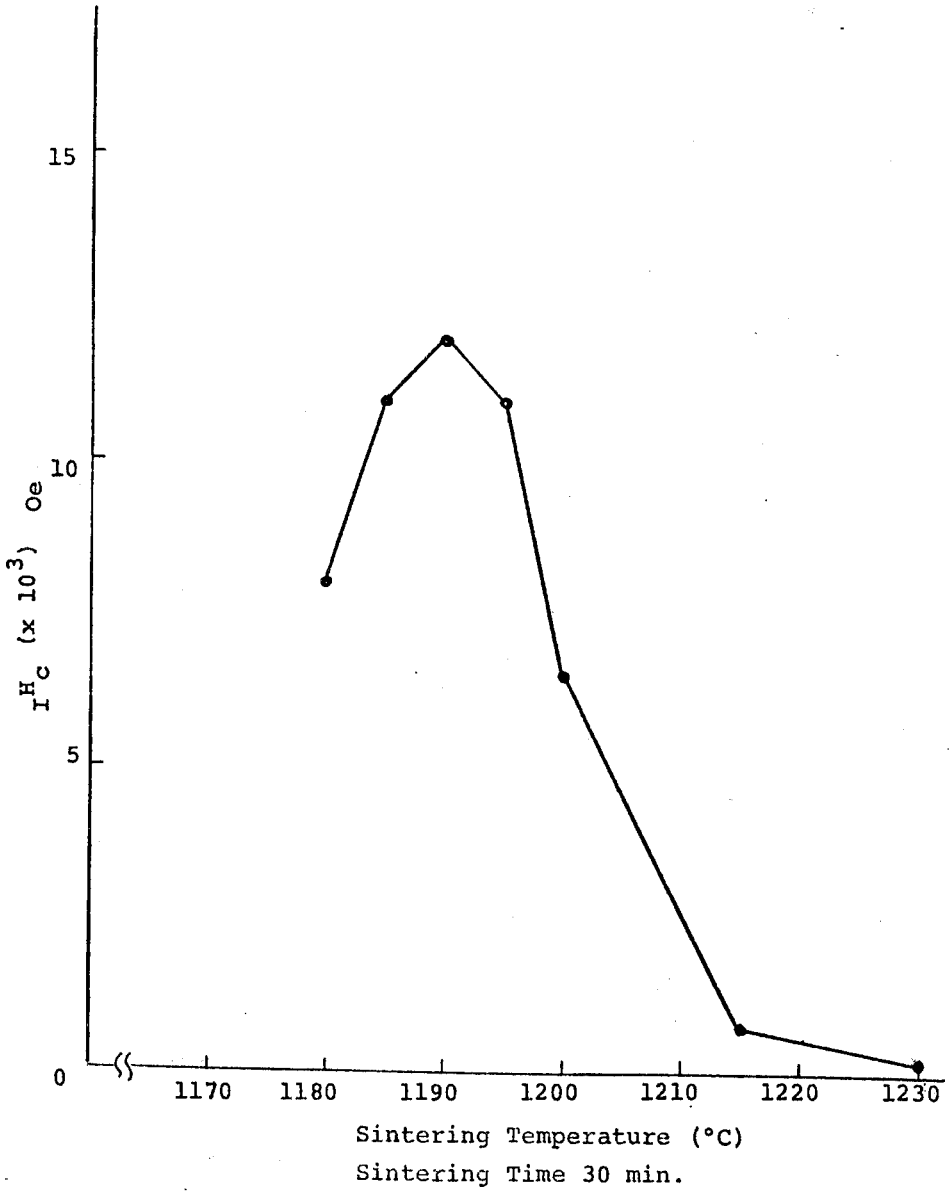
FIG. 3 shows intrinsic coercive force for other specimens having the nominal composition of $Sm(Co_{0.83}Fe_{0.05}Cu_{0.1})_{8.0}$ as function of a sintering temperature at a sintering time of 30 minutes.

FIG. 3 shows intrinsic coercive force as function of sintering temperature in the specimens of Z19 with a sintering time of 30 minutes.

What is claimed is:

1. A sintered magnetic material consisting essentially of samarium, cobalt, iron and copper, said composition being expressed by the formula $Sm(Co_{1-x-y}Fe_xCu_y)_z$, in which $x$ is 0.01 to 0.15, $y$ is 0.05 to 0.15 and $z$ is 7.8 to 8.2, said sintered material having an average grain size less than 10 microns and exhibiting a coercive force of at least about 10,600 Oe.

* * * * *

UNITED STATES PATENT AND TRADEMARK OFFICE

CERTIFICATE OF CORRECTION

PATENT NO. : 4,121,952

DATED : October 24, 1978

INVENTOR(S) : Harufumi Senno and Yoshio Tawara

It is certified that error appears in the above-identified patent and that said Letters Patent are hereby corrected as shown below:

On the title page, under United States Patent [19] and in item [75], "Senn" should read -- Senno --.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*